United States Patent [19]

Geiger

[11] Patent Number: 4,736,553

[45] Date of Patent: Apr. 12, 1988

[54] ROOF STRUCTURE

[76] Inventor: David H. Geiger, Kirby La., Rye, N.Y. 10580

[21] Appl. No.: 939,170

[22] Filed: Dec. 8, 1986

Related U.S. Application Data

[63] Continuation of Ser. No. 608,424, May 9, 1984, abandoned.

[51] Int. Cl.[4] ..... E04B 1/342; E04C 3/02

[52] U.S. Cl. ..... 52/81; 52/694; 135/103; 135/DIG. 8

[58] Field of Search ..... 14/8, 20, 21, 22, 18; 135/DIG. 8, 101, 102, 103, 97, 104; 52/63, 83, 227, 646, 645, 641, 86, 694, 81, 82

[56] References Cited

U.S. PATENT DOCUMENTS

| | | | |
|---|---|---|---|
| 2,349,993 | 5/1944 | Schwimmer | 135/DIG. 8 |
| 3,139,957 | 7/1964 | Fuller | 52/81 |
| 3,886,961 | 6/1975 | Geiger | 52/82 |
| 4,130,969 | 12/1978 | Ivanov | 52/83 |

FOREIGN PATENT DOCUMENTS

| | | | |
|---|---|---|---|
| 394514 | 1/1974 | U.S.S.R. | 52/83 |

OTHER PUBLICATIONS

Inventions–The patented work of R. Buckminster Fuller, pp. 201–213, copyright 1983.

Glass Tension Structures and Space Frames by Architectural Institute of Japan 1972, pp. 537–541.

*Primary Examiner*—John E. Murtagh

*Attorney, Agent, or Firm*—Mortenson & Uebler

[57] ABSTRACT

A cable truss dome which is not triangulated is constructed from a plurality of cables under tension and compression members arranged in triangles having non-common sides. The cable truss dome is adapted for spanning large areas where the cables form a low shallow arch which supports a flexible membrane as a covering. The non-common vertex of the formed triangles are connected to similarly placed vertical sides of other triangles through continuous nested tension rings.

15 Claims, 7 Drawing Sheets

ROOF STRUCTURE

CROSS-REFERENCE TO RELATED APPLICATION

This application is a continuation of prior pending application Ser. No. 608,424, filed May 9, 1984, now abandoned.

BACKGROUND OF THE INVENTION

The present invention relates in general to a roof structure, and more particular, to such a roof structure constructed of tension members and compression members arranged in the form of a cable truss dome suitable for spanning delineated areas of various size for providing a protective roof thereover for stadiums, arenas, and the like, where a dome like volume has been created.

In recent years, dome and roof structures have been constructed of light weight membranes in order to achieve lower cost and to improve their performance. These structures have been constructed of either synclastic surfaces held-up and stiffened by air pressure or anticlastic surfaces formed by ridged arches, masts, and/or cables against which the membrane has been prestressed. the synclastic surface may have a low aspect ratio, that is, the ratio of surface area to delineated plan area. The resulting low aspect ratio has an important advantage for permanent membrane roofs, such as low profile air structures, since the membrane cost is as much as 70% of the roof cost, the balance being cables, clamps, and compression ring. However, the disadvantage of the air structure has been its dependence on mechanical systems for keeping the roof up and the resulting requirement for providing air tight buildings, snow melting systems, emergency generators, revolving doors, and the like. On the other hand, the anticlastic surface has a very high aspect ratio resulting in higher roof costs per unit of delineated plan area. For example, those anticlastic surfaces employing masts and cables have high aspect ratios in order to provide sufficiently low membrane stress, while those utilizing arches have high aspect ratios due to design considerations such as arch buckling.

In addition to the foregoing problems encountered with regard to the use of light weight membranes consisting of either synclastic or anticlastic surfaces, there is a problem of roof insulation. Previous attempts to incorporate insulation in air supported roofs have required the installation of snow melting systems separate and apart from the interior heating system so as to prevent condensation of moisture on the upper covering membrane thereby impairing the insulation value of the insulation. In addition, there is the requirement to pressurize the insulation space to pressures higher than the interior pressure of the enclosed delineated area in order to prevent the collapse of the insulation.

Another difficulty encountered with certain roof structures of the prior art is the inability to resist wind induced up-lift forces exceeding the dead weight of the roof structures. Further, difficulties are often encountered in erecting these structures constructed of continuous flexible elements such as cables with discontinuous stiff elements such as compression struts as they generally do not have the required stiffness except in their complete assemblied condition.

It can therefore be appreciated that there is an unsolved need for a tension structural system, such as a cable truss dome, which is adaptable for spanning large areas where the tension elements form low shallow arches that support a light weight membrane on their upper ridge cables and held down by valley cables arranged between the arches, and which is adaptable for providing a low aspect ratio tension structural system which eliminates the need for supporting air pressure and allows for the insulation of low cost light weight membrane roofs.

SUMMARY OF THE INVENTION

It is broadly an object of the present invention to provide a roof structure, and more particularly a cable truss dome, for spanning a delineated area which avoids or overcomes one or more of the foregoing disadvantages resulting from the use of the above-mentioned prior art structures, and which fulfills the specific requirements of such a roof structure for supporting a roof thereon. Specifically, it is within the contemplation of one aspect of the present invention to provide a roof structure in the form of a cable truss dome that is not triangulated and can be built by assembling certain components on the ground and assembling other components in a hanging position, with or without a covering membrane, and then hoisting these elements into final position using cable prestressing jacks.

In accordance with one embodiment of the present invention, there is provided a roof structure for spanning a delineated area. The roof structure is constructed of members spanning the delineated area for supporting a roof thereon, the members comprising tension members and compression members, the tension members forming continuous tension members spanning a portion of the delineated area and additionally discontinuous tension members, the compression members being attached between the continuous tension members and/or the discontinuous tension members.

In accordance with another aspect of the present invention, there is provided a roof structure for spanning a delineated area. The roof structure is constructed of arched members spanning a delineated area for supporting a dome like roof thereon, the arched members comprising tension members and compression members arranged together to form triangles therefrom, the tension members forming two adjacent sides of the triangles and the compression members forming the other sides thereof, and nested concentric tension rings, which arch as well, connected to the lower ends of corresponding compression members.

In accordance with yet another aspect of the present invention, there is provided a roof structure for spanning a delineated area, the structure comprising support members spanning the delineated area for supporting a roof thereon, the support members comprising tension members and compression members, the tension members forming top and bottom chords spanning a portion of the delineated area and diagonal members extending therebetween, the compression members attached between the top chords and the bottom chords.

BRIEF DESCRIPTION OF THE DRAWINGS

The above description, as well as further objects, features and advantages of the present invention will be more fully understood by reference of the following detailed description of the presently preferred, but nonetheless illustrative, roof structure in the form of a cable truss dome in accordance with the present invention, when taken in conjunction with the accompanying drawings; wherein.

DETAILED DESCRIPTION

Figure 1:
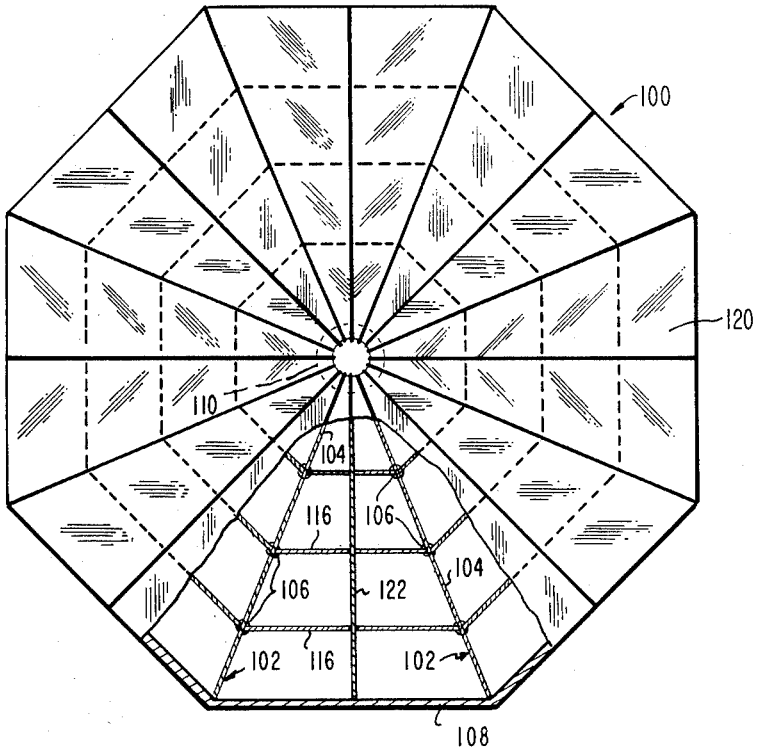
FIG. 1 is a top plan view showing the roof structure constructed of a cable truss dome including a plurality of radially arranged arched support members having a top chord comprising a ridge cable and a plurality of concentric tension rings, and including a valley cable radially disposed between adjacent arched support members.

Referring now to the drawings wherein like reference numerals represent like elements, there is shown in FIG. 1 a plan view of a roof structure in the form of a cable truss dome and indicated generally by reference numeral 100. The cable truss dome 100 forms an undulating supporting surface and is constructed of a plurality of arched support members 102 arranged radially spanning the delineated area having a dome like volume created to be enclosed. Generally, and as further shown in FIG. 2, the members 102 are constructed of a plurality of stranded cables 104 forming a tension member and a plurality of rigid struts 106 forming compression members. The cables 104 are attached to a continuous compression ring 108 which is arranged circumscribing the delineated area to be covered. Alternatively, the cables 104 may be secured to a plurality of individual anchorage blocks (not shown) buried in the ground at locations circumscribing the perimeter of the delineated area. As shown in FIG. 1, the compression ring 108 can be constructed as a portion of the perimeter wall defining the stadium or arena to be covered. The cables 104 extend radially from the compression ring 108 overlying a portion of the delineated area and have their other ends secured to a center tension ring 110 or at the top or bottom of struts 106, as shown in greater detail in FIGS. 3 and 4.

Figure 2:
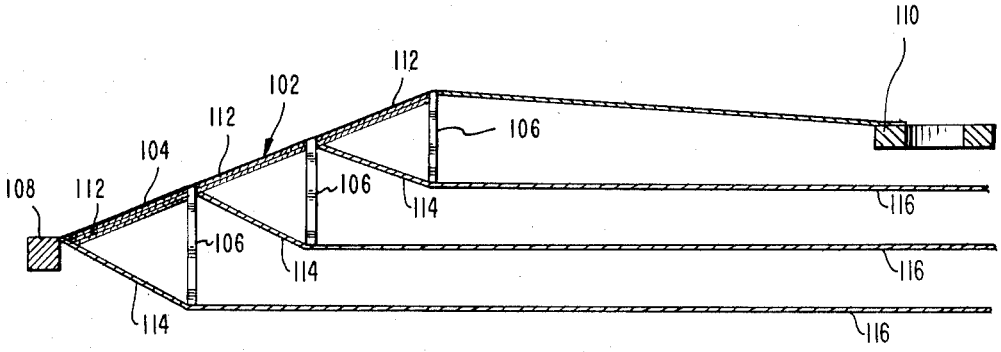
FIG. 2 is a partial side elevational view of one arched member showing one radially arched member constructed of a plurality of tension members in the form of cables to provide top chords and diagonal members that terminate at the vertices of the tension rings and compression members in the form of vertical struts arranged between the two chords and the termination of the diagonal members.
Figure 7:
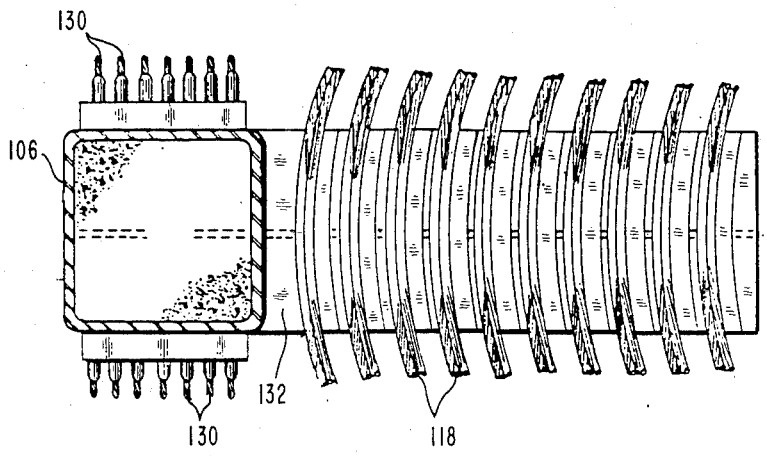
FIG. 7 is a top plan view in cross-section of the compression member as shown in FIG. 5 and further showing a platform supported by a plurality of tension rings at the bottom of the compression member.
Figure 8:
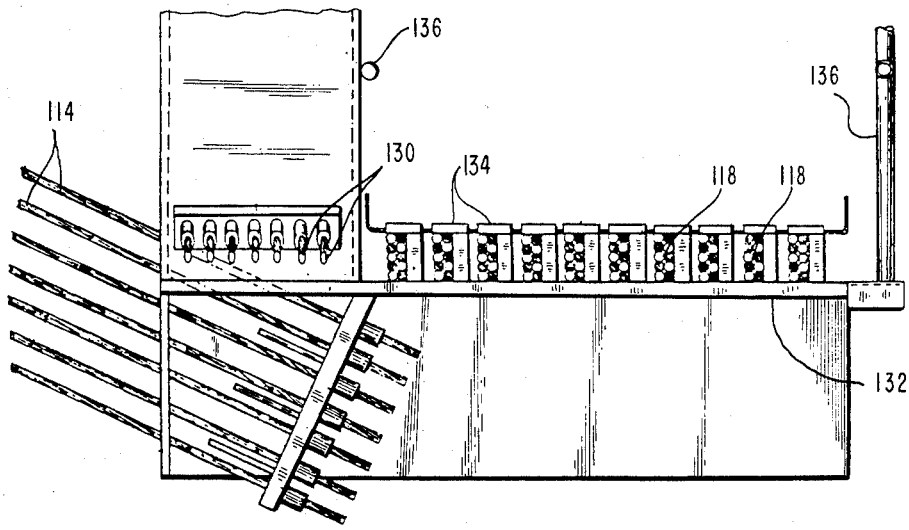
FIG. 8 is a partial side elevational view of the bottom of the compression member and platform as shown in FIG. 7.

Cables 104 extending from the compression ring 108 to the center tension ring 110 form top chords 112 or ridge cables of the members 102. On the other hand, a number of these cables 104 initiating from the compression ring 108 become diagonal members 114 or diagonal cables extending downwardly at an angle from successive predetermined locations along the members 102. As best shown in FIG. 2, a plurality of cables 104 are secured to the compression ring 108 and extend radially towards the tension ring 110. At a first predetermined location, a number of cables 104 are peeled away from the remaining cables and are arranged extending downwardly from those remaining cables forming the top chord 112 to provide the diagonal members 114. Similarly, at the next successive predetermined location, a number of cables 104 are again peeled away from the remaining cables 104 and extend at an angle downwardly from those remaining cables forming the top chord 112 to provide another diagonal member 114. The top chords 112 and underlying diagonal members 114 form two adjacent sides of a triangle. Struts 106 are connected between the top chords 112 and diagonal members 114 formed by the cables 104 to complete the third side of the triangle by means of the structure shown in FIGS. 5 through 8 as to be described hereinafter. The thus formed triangles are arranged in a substantially vertical orientation lying within a common plane containing a support member 102. As shown in FIG. 2, the triangles formed by the top chords 112, diagonal members 114, and struts 106 are provided independent of one another in that these triangles do not have common sides. In this manner, the struts 106 are vertically arranged having their upper ends attached to the cables 104 at the intersection of the top chords 112 and diagonal members 114 of an adjacent triangle. As thus far described, the number of cables 104 forming the top chords 112 successively decrease as a corresponding number of these cables are peeled away to provided the diagonal members 114. In other words, the number of cables 104 contained within each diagonal member 114 may be the same, although they may vary, while on the other hand, the number of cables contained within the top chords 112 decreases from the compression ring 108 to the center tension ring 110. In completing the support members 102, a plurality of concentric tension rings 116 constructed of a plurality of stranded cables 118 are secured to the lower ends of corresponding struts 106 within adjacent support members 102 as best shown in FIGS. 7 and 8.

Overlying the support members 102 is a flexible membrane 120 serving as a roof for the domed volume created by the delineated area to be covered. The membrane 120 may be formed of a woven synthetic fabric material, although it is contemplated that other materials such as canvas or thin metallic formed membranes may also be utilized. The membrane 120 is constructed to be weather resistant and preferably of a non-combustible composition. Coated fabrics may be employed for the membrane 120 such as Teflon coated fiberglass, silicon coated fiberglass, silicon coated polyester, and the like. In addition, the membrane 120 can be translucent to allow light in, as well as having good acoustical properties if desired, depending upon the use contemplated of the covered stadium or arena. A plurality of valley cables 122 are positioned between adjacent support members 102 and extend between the compression ring 108 and tension ring 110. The flexible membrane 120 is maintained under tension by prestressing the valley cables 122, for example, as disclosed in U.S. Pat. No. 3,807,421 issued to the inventor of the within application. That portion of the flexible membrane 120 extending in V-shaped cross-section between adjacent support members 102 can be in the form of rectangles, trapizodes, triangles, wedge shape, and the like. In this regard, the flexible membrane 120 can be constructed of a plurality of triangular shaped panels radiating outwardly from the center tension ring 110 such that the joints between adjacent panels can be continuously heat sealed or glued in place during field installation so that there are no intersecting joints with those of adjacent panels.

Figure 5:
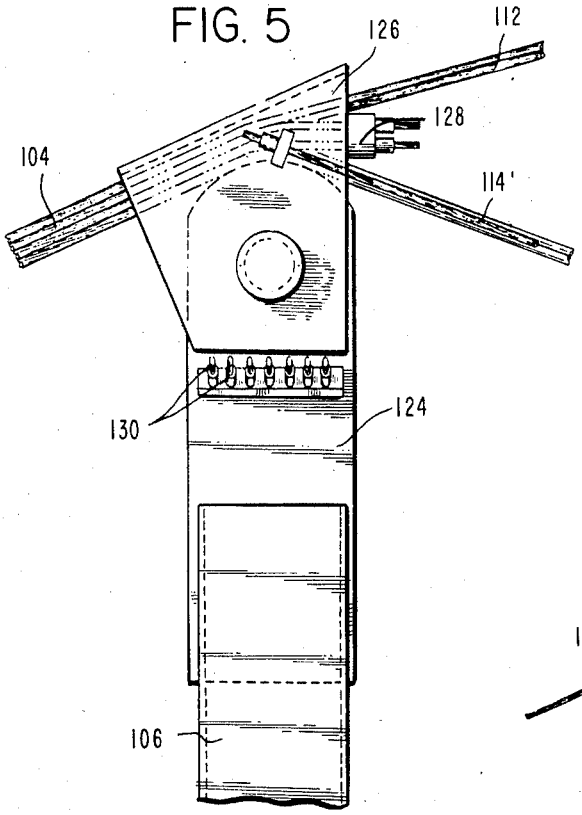
FIG. 5 is a partial side elevational view of the top of a compression member showing the compression member in the form of a strut and attached to a tension member by means of a hanger.
Figure 6:
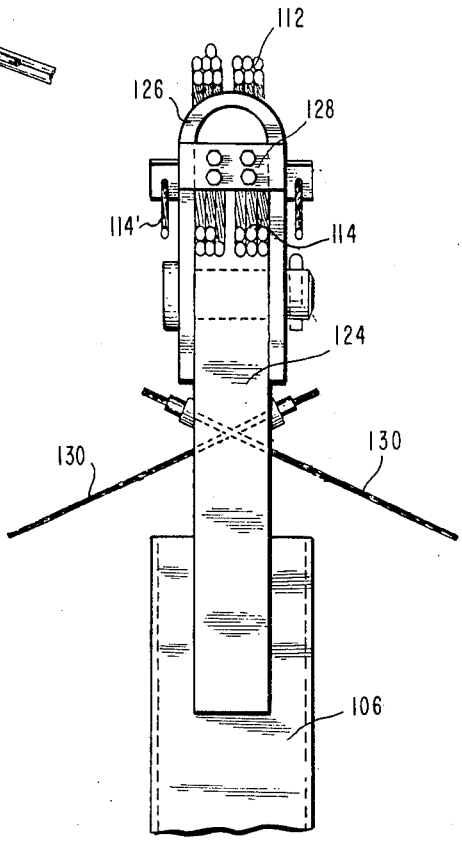
FIG. 6 is a partial front elevational view of the compression member and hanger used during construction as shown in FIG. 5.

Turning now to FIGS. 5 and 6, the struts 106 are attached to the cables 104 at predetermined locations by means of a hanger 124. The upper end of the hanger 124 is provided with a pivotable U-shaped bracket 126 through which the cables 104 extend. To secure the bracket 126 to the cables 104, a number of cables may be terminated and secured to the hanger by means of a fixture 128. As previously noted, a number of cables 104 extend through the U-shaped bracket 126 and are displaced at an angle downward to provide the diagonal members 114. In addition, supplemental diagonal members 114' may be employed by securing same between the hanger 124 and the lower end of an adjacent strut 106 as shown. Bracing between adjacent support members 102 is not required due to the fact that the cables 104 forming the top chords 112 and diagonal members 114 are under tension. However, trussing or cross-bracing between adjacent support members 102 can be provided for the purpose of load redistribution and facilitating the erection of the cable truss dome 100. In this regard, the trussing or bracing can be achieved by providing crossbracing in the form of diagonal cables 130 secured between corresponding struts 106 within adjacent support members 102. In particular, the diagonal cables 130 are secured at one end to the hangers 124 and attached at their other ends to the lower ends of corresponding struts 106, as shown in FIGS. 7 and 8. Although the diagonal cables 130 are shown seven in number, it is expected that only two or three such diagonal cables would be required. To facilitate load redistribution, these diagonal cables are clamped at their cross point.

Figure 3:
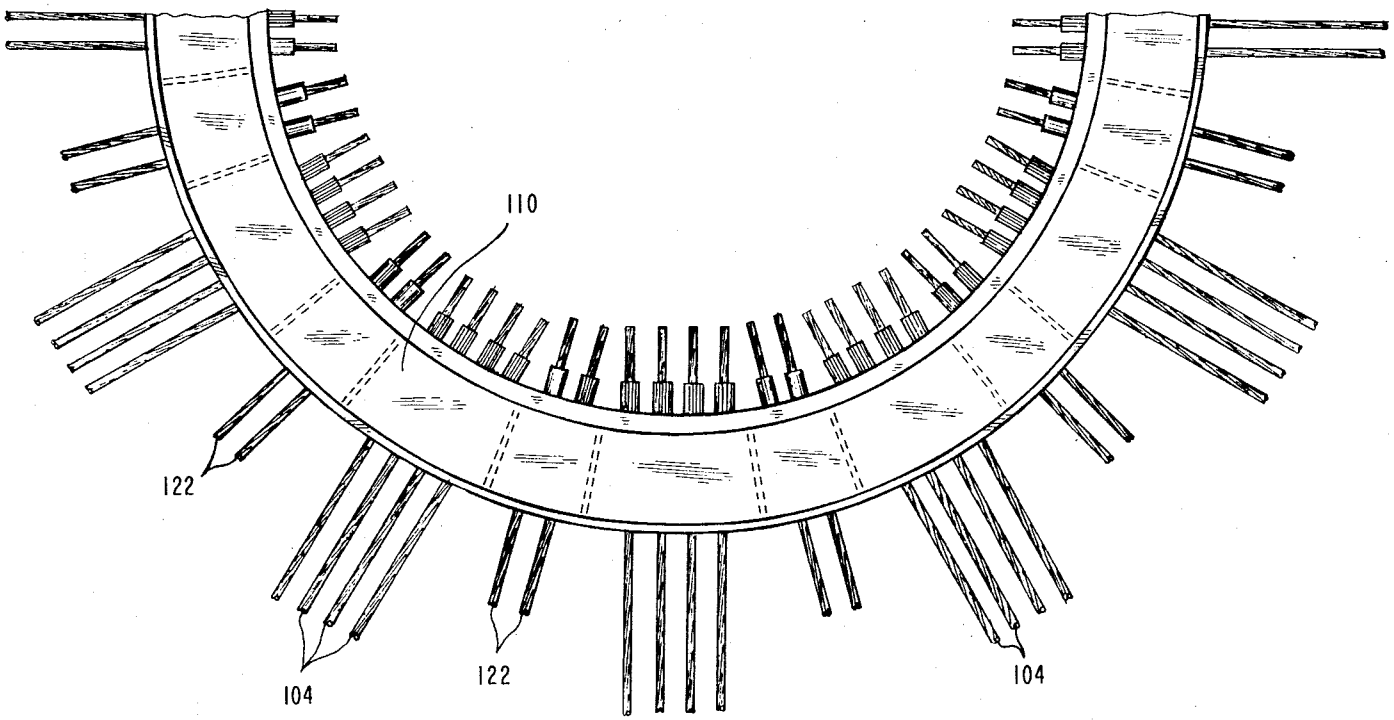
FIG. 3 is a partial top plan view of a tension ring having a plurality of arched support members attached thereto and extending radially outward therefrom along with the adjacent valley cables.
Figure 4:
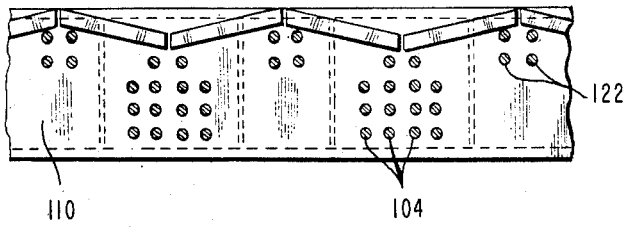
FIG. 4 is a partial side elevational view of the tension ring as shown in FIG. 3.

These cables 104 continuing through the hangers 124 within a support member 102 are secured to the ring shaped tension ring 110 in the manner shown in FIGS. 3 and 4. In addition, the valley cables 122 are also secured to the center tension ring 110 between adjacent cables 104. Thus, the support members 102 have one end attached to the tension ring 110 and extend radially outward therefrom, while having their other ends attached to the compression ring 108. The lower ends of the struts 106 are provided with a support 132 arranged generally transverse to the strut and extending outwardly along the direction of the support members 102. The support 132 is adapted for securing the cables 118 of the individual concentric tension rings 116 thereto. A plateform 134 is disposed overlying the cables 118 to provide a catwalk for maintenance and installation personnel. The platform 134 is arranged overlying the concentric tension rings 116 between adjacent struts 106 and including a safety handrail 136 on either side of the platform.

As thus far described, the cable truss dome 100 incorporates a structural system that uses trusses that have top chords 112 made of tension members comprising a plurality of prestressed cables 104. The cables 104 are anchored to the compression ring 108 or buried anchorage blocks (not shown). The diagonal members 114 are arranged discontinuous from one another and nested concentric tension rings 116 to which the diagonal members are attached. As the cable truss dome 100 is now a tension dome and dome buckling is not a problem, the rise of the dome can be made as shallow as possible consistant with water drainage and stadium interior functions. That is, the aspect ratio, i.e., ratio of dome surface area to delineated plan area, can be made a minimum. The anticlastic membrane surface can be prestressed by the valley cables 122 that pull the flexible membrane 120 down against the top chords 112 of each of the support members 102. With the top chords 112, diagonal members 114, and tension rings 116 constructed of cables prestressed to a perimeter restraining system, i.e., compression ring 108, these elements can be combined with rigid elements such as beams or trusses in such a manner so as to impart additional stiffness to these elements without introducing compression forces.

The uniqueness of the cable truss dome 100 is demonstrated by the fact that it is not triangulated. The rigidity of a triangular structure is not required of the cables truss dome 100 as structural roof membranes, i.e., architectural fabrics, permit the membrane to act as both a deck and a weathering membrane. This membrane, if properly shaped and prestressed, can accommodate the large displacements of a structural system that is not triangulated. Thus, non-linear large displacement structural analysis is possible using digital computers. In addition, the cable truss dome 100 permits circular and non-circular plan configurations based on skewed symmetric principles, for example, as in U.S. Pat. No. 3,841,038 issued to the inventor of the within application. As previously noted, the prestressed flexible membrane 120 covering the cable truss dome 100 has shallow undulations permitting the ratio of surface area to delineated plan area to be a minimum thus allowing maximum economy of the flexible membrane. This economy is further enhanced by the use of individual multi-stranded cables 104 which permit maximum efficiency in the use of material in the top chords 112 and diagonal members 114. This efficiency is achieved in that the number of individual cables 104 required in the top chords 112 decreases as one goes from the perimeter to the center of the delineated area. This amount of decrease in the individual cables 104 can be of the same order of magnitude as the number of cables required in the individual diagonal members 114. Consequently, the number of end connections required of the cables 104 is minimized and since cable costs are very much a function of the end connections, the cable costs are correspondingly reduced. Further, the use of a plurality of cables 118 in the construction of each of the tension rings 116 allows the resulting structure to function as the support for a catwalk as previously described.

The use of the cable truss dome 100 is a practical consideration because of the efficiency with which the cable end forces can be resisted through the use of skewed symmetric compression rings or anchorage blocks. Given the flexibility of the cable truss dome 100, and the fact that it is not triangulated, such facts are advantages because the cable truss dome can be largely assembled on the ground or in a hanging position, with or without the flexible membrane 120, and then hoisted into position using simple cable tensioning devices that are used to put the final tension into the cables 104 as to be now described.

The method for erection of the cable truss dome 100 will be described with reference to FIGS. 9 through 15. The erection of the cable truss dome 100 uses the natural propensity for cables to drape in a concave upward position between anchor points under gravity loads. The tension ring 110 is supported on a scaffolding 138 or alternatively may be positioned on the ground and hoisted in place by jacking of the ridge cables. A bundle of cables 104, including the top chords 112 and diagonal members 114 are radially positioned about the delineated area to be covered. The perimeter ends of the cables 104 are secured to the compression ring 108 while the other ends of those cables providing the top chords 112 are secured to the tension ring 110. Those cables 104 providing the diagonal members 114 are allowed to drape downwardly from the remaining cables at successive locations corresponding to the placement of the struts 106 along each support member 102. The length of some of the diagonal members 114 are greater than required of the erected cable truss dome 100 in order to facilitate erection purposes as to be described.

Figure 9:
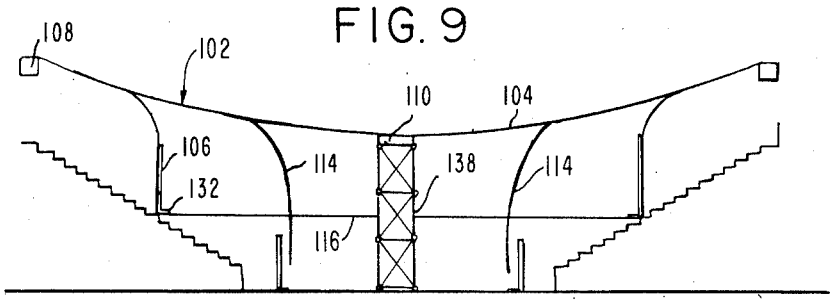
FIGS. 9 through 15 diagrammatical illustrations showing the erection sequence for the roof structure in accordance with the present invention.

The struts 106, having attached hangers 124 and supports 132, are positioned on the ground, scaffolding and/or stadium seating as shown in FIG. 9. The struts 106 are securely set so that their plan position relative to each other is maintained during the attachment of the concentric tension rings 116. The cables 118 are spun overlying the supports 132 of corresponding struts 106 to provide the plurality of concentric tension rings 116. The tension rings 116 are slightly tensioned as they are attached to the supports 132 of each of the struts 106. The struts 106 having attached hangers 124, supports 132 and tension rings 116, are lifting vertically upward and secured to those cables 104 forming the top chords 112. Alternatively, the hangers 124 and struts 106 may be attached to the cables 104 first and the tension rings 116 can be later attached to the struts 106 during erection of the cable truss dome 100. The attachment of the hangers 124, to the cables 104 is achieved by pivotally attaching the U-shaped bracket 126 over the cables 104 to the upper end of the hangers 124, and securing the cables thereto by means of the fixture 128. The cables 104 providing the diagonal members 114 are inserted through the lower end of the struts 106. This procedure is repeated for all concentric rings formed by corresponding struts 106 and the tension rings 116. It is further contemplated that after the struts 106 have been securely set on the ground, cables 104 may then be arranged spanning the delineated area by successively attaching them to the top of one strut and then to the bottom of an adjacent strut, so as to form the diagonal members 114 therebetween. This alternative method allows the cable truss dome 100 to be easily assembled and erected from a ground level position.

Figure 10:
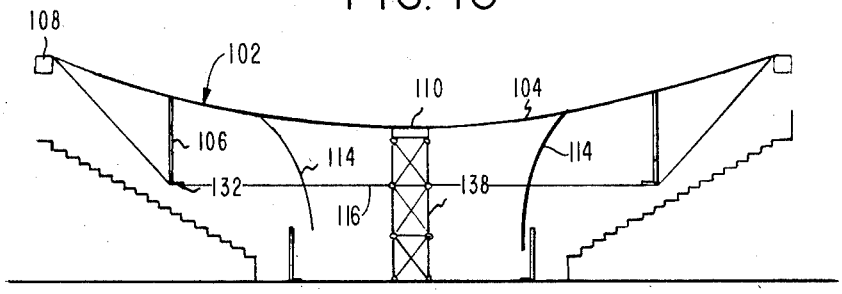
Figure 11:
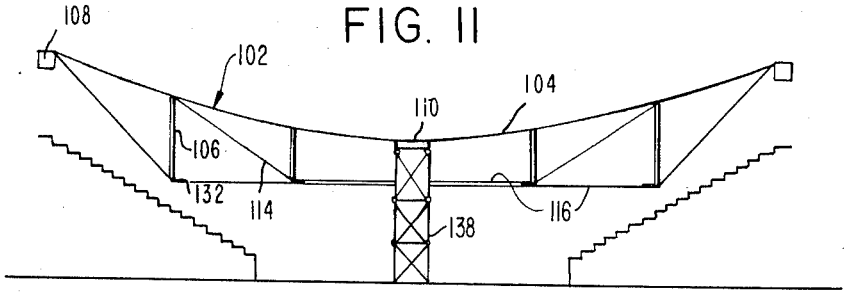
Figure 12:
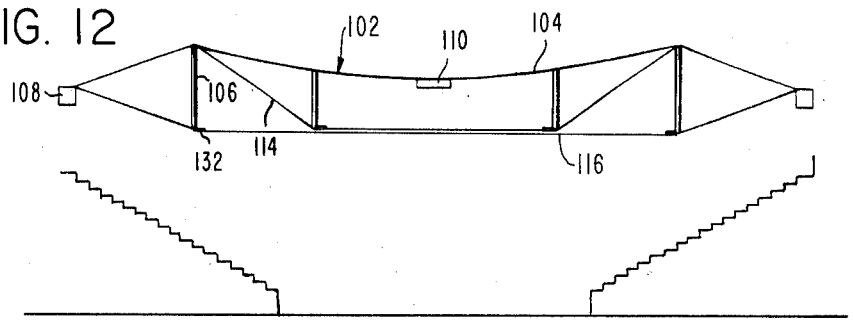
Figure 13:
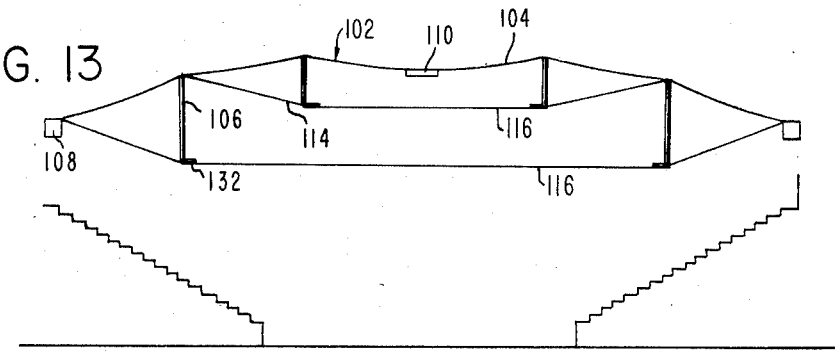
Figure 14:
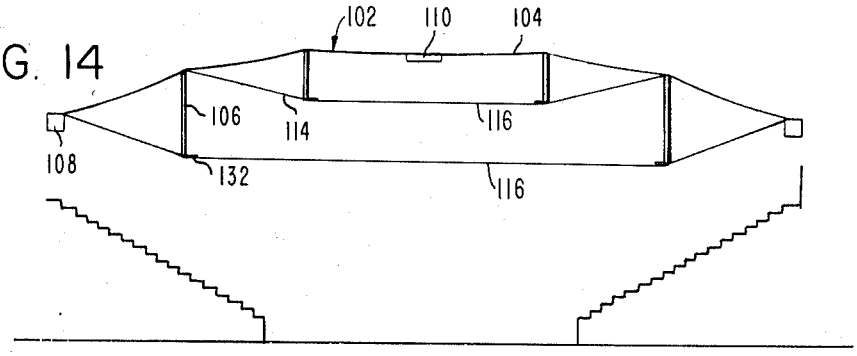
Figure 15:
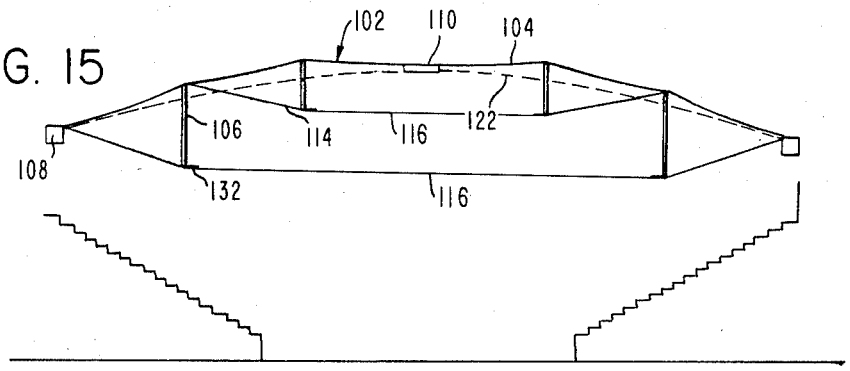

Engaging the free ends of the diagonal members 114 at the outer most struts 106, these diagonal members are then jacked by shortening their length through the struts so that the cables 104 forming the top chords 112 and the diagonal members 114 are placed under tension which then lifts the outer portion of the support members 102 upwardly as shown in the sequence between FIGS. 10 and 12. The jacking of the diagonal members 114 is repeated for each of the concentric rings formed by the corresponding struts 106 and tension members 116 so as to place all cables 104 within the cable truss dome 100 in tension thereby causing the cable truss dome to invert as shown between the erection sequence of FIGS. 11 through 14. The diagonal members 114 are then secured to the struts 106 in completing the structure of the cable truss dome 100. As previously noted, optional cross-bracing 130 may be provided between adjacent corresponding struts 106, as well as installation of the platform 134 to provide a catwalk. The cable truss dome 100 is covered with the flexible membrane 120 and prestressed by tensioning the valley cables 122 or tensioning the diagonals 114.

As thus far described, the interior tension rings 116 are spun at grade level or on a support structure such as stadium seating and lifted with the struts 106 for attaching same to the cables 104 providing the top chords 112. The cables 104 forming the top chords 112 are in an inverted position and are subsequently made to assume a concave downward position by simultaneous shortening the diagonal members 114, one concentric ring at a time, so as to cause the support members 102 to reverse curvation one ring at a time. Alternatively, it is contemplated that the flexible membrane 120 may be attached to the cables 104 and valley cables 122 for inflating the roof structure using mechanical blowers. The upward movement of the flexible membrane 120 by means of mechanical blowers cause the reversing of the curvature of the support members 102 and brings the struts 106 into their approximately final positions where the diagonal chords 114 can be attached. Using hydraulic jacks, the struts 106 can be brought into their final position in which the support members 102 have assumed a concave downward position at which time the internal pressure created by the mechanical blowers is no longer required to hold the cable truss dome 100 up. By performing the erection sequence at grade level, or as close to ground as possible, such sequence is greatly facilitated.

In accordance with the present invention, there has been disclosed an erection sequence for raising a roof structure into the form of a cable truss dome 100. The method comprising the steps of spanning a delineated area with tension members, attaching compression members to the tension members at predetermined locations, attaching tension rings to corresponding compression members among the tension members attaching a number of tension members to the compression members to form diagonal members therefrom, and inverting the tension members spanning the delineated area to form the roof structure.

Figure 16:
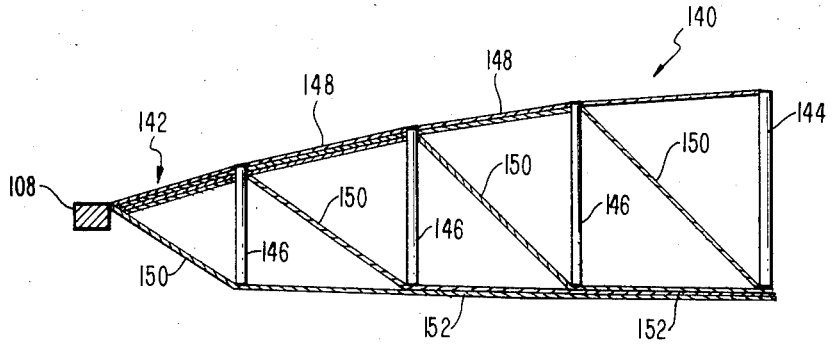
FIG. 16 is a partial side elevational view of a cable truss in accordance with another embodiment of the present invention constructed of tension members and compression members, wherein the tension members form top and bottom chords and diagonal members extending therebetween.
Figure 17:
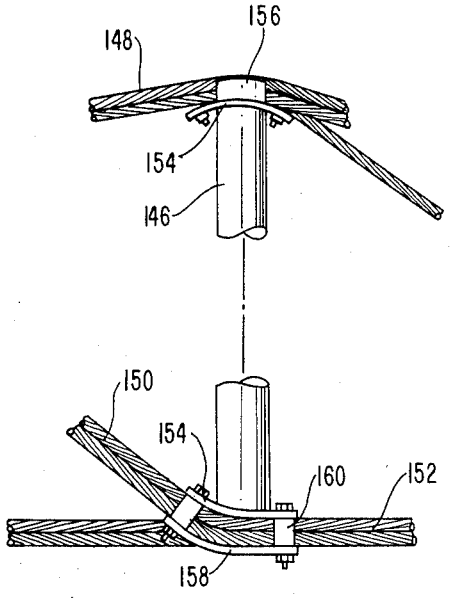
FIG. 17 is a partial side elevational view of the compression members shown in FIG. 16 connected between the top and bottom chords by a bracket.

Turning now to FIGS. 16 and 17, there is shown half of a cable truss 140 in accordance with another embodiment of the present invention. The cable truss 140 is constructed of a plurality of tension members 142 arranged spanning the delineated area to be covered with, for example, a flexible member 120 of the type illustrated in FIG. 1. The tension members 142 are constructed of stranded cables of the type described and illustrated with respect to the previous embodiment. The spanning the delineated area, one end of the tension members 142 are attached to a continuous compression ring 108 which is arranged circumscribing the delineated area to be covered. Alternatively, the tension members 142 may be secured to a plurality of individual anchorage blocks (not shown) buried in the ground at locations circumscribing the perimeter of the delineated area. The tension member 142 extend overlying a portion of the delineated area and have their other ends secured to a center tension ring 144 in the manner to be described, or in the case of a linear truss spans to the other side. In addition to the tension members 142, the cable truss 140 also includes a plurality of rigid struts 146, which may be of varying length, and which forms compression members similar in function to the struts 106 as shown in FIG. 2.

The tension members 142 are arranged in the cable truss 140 to form therefrom top chords 148, diagonal members 150 and bottom chords 152. As shown, the number of cables within the top chords 148 decrease from the compression ring 108 to the tension ring 144, while the number of cables within the bottom chords 152 increase from the compression ring to the tension ring. By way of an example, a plurality of continuous tension members 142 are secured to the top of a first strut 146, thereby forming a top chord 148 between the compression ring 108 and first strut 146. A tension member 142 is attached to the bottom end of an adjacent second strut 146' to form a diagonal member 150 therebetween. The tension member 142 forming the diagonal member 150 is then attached to the bottom end of the remaining strut 146" and having its free end attached to the lower end of the tension ring 144. The remainder of the tension members 142 attached to the top end of the first strut 146, are secured to the top end of the adjacent second strut 146' to form top chord 148. The number of cables in the top chord 148 running between the adjacent first and second struts 146, 146' are less than the number of cables in the top chord running between the compression ring 108 and first strut 146. Likewise, a tension member 142 connected to the top of the second strut 146' is attached to the lower end of the adjacent third strut 146" to form diagonal member 150, and ultimately to the lower end of the tension ring 144 to form the bottom chord 152. The remaining tension members 142 attached to the upper end of the second strut 146' are attached to the upper end of the adjacent third strut 146" in the previous manner described.

It should therefore, be appreciated that the number of cables within the top chords 148 between successive struts 146, 146', 146" decrease in number, while the number of cables within the tension members 142 forming the bottom chords 152 increase between successive struts. In other words, the tension members 142 extend continuously from the compression ring 108 to the tension ring 144 in the form of a top chord 148, a diagonal member 150 and bottom chord 152. In turn, the struts 146, 146', 146" are secured between the top chords 148 and bottom chords 152 to maintain the tension members 142 under tension upon application of a load.

As shown in FIG. 17, the struts 146 are secured to the tension members 142 by means of a saddle-type bracket 154, 154'. As shown, the upper and lower brackets 154, 154' are secured to the ends of the strut 146. The upper bracket 154 is provided with a pair of spaced apart ears 156 between which the tension members 142 are retained. The lower bracket 154' is in turn provided with a U-shaped restrainer plate 158 to sandwich the tension members 142 therebetween, which tension members are also confined between spaced-apart bushings 160. In this manner, the struts 146 are attached between the tension members 142, i.e., the top chords 148 and bottom chords 152, so as to maintain the tension members under tension during an applied load.

The method for erection of the cable turss 140 will now be briefly described. In this regard, it is to be noted that the erection of the cable truss 140 is, somewhat, similar to the method of erection of the cable truss dome 100, which was previously been described with reference to FIGS. 9–15. Specifically, a bundle of tension members 142 are arranged overlying the delineated area between the compression ring 108 and tension ring 144. A plurality of struts 146 are attached to teh tension members 142 at intermediate locations between the compression ring 108 and tension ring 144, so that the tension members are formed into top chords 148, diagonal members 150 and bottom members 152, as shown in FIG. 16. The tension members 142 and struts 146 may be assembled on the ground or using a scaffolding 138 in the manner previously described. The cable truss 100 is erected by tensioning the tension members 142 by engaging their free ends at their location at the compression ring 108. The tension members 142 are respectively tensioned by shortening their length between the compression ring 108 and tension ring 144, so that the tension members forming the top chords 148, diagonal members 150 and bottom chords 152 are placed under tension, which then lifts the outer portion of the cable truss 140 upwardly. By successively tensioning those tension members 142 which form the next adjacent inward diagonal member 150, all tension members within the cable truss 140 are placed in tension, thereby causing the cable truss to be raised into its tensioned self-supporting position, as shown in FIG. 16. Additionally, option cross-bracing 130 may be provided between adjacent corresponding struts 146. The cable truss 140 can then be covered with a flexible member 120 and pre-stressed by the tensioning of valley cables 122, which are attached between the tension ring 144 and compression ring 108.

Although the disclosure herein as been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of the present invention as defined by the appended claims.

What is claimed is:

1. A structure for supporting a roof thereon comprising:

a generally horziontal outer compressiong ring, a generally horizontal inner tension ring, a plurality of radially oriented support members affixed to said outer compression ring and extending radially inwardly therefrom and being affixed to said inner tension ring, each support member comprising, in a generally vertical plane, at least one upper, arched tensioned member forming a top chord, at least one diagonal tensioned member extending inwardly, downwardly and diagonally from said upper tensioned member, and at least one substantially vertical, rigid strut in compression attached at its upper end to said upper tensioned member and attached at its lower end to said diagonal tensioned member, each such set of upper tensioned member, diagonal tensioned member and strut in compression forming a triangle in a generally vertical plane, these triangles forming discrete groups of triangular supports located at common radial positions between outer compression ring and inner tension ring, every said triangle in each said radially oriented support member having noncommon sides with every other triangle in said support member, and at least one generally horizontal tensioned hoop concentric with said outer compression ring and said inner tension ring and being affixed to the lower ends of each said strut in compression in each said group of triangular supports.

2. The structure of claim 1 wherein said tensioned members comprise a plurality of cables.

3. The structure of claim 2 wherein the number of cables of the top chord decreases proceeding inwardly from said compression ring to said inner tension ring, at least one said cable in said top chord being peeled away to form said diagonal tensioned member of the next inwardly-proceeding triangle within said support member.

4. The structure of claim 1 wherein said horizontal concentric tension hoop comprises a plurality of cables.

5. The structure of claim 1 including a covering overlying said structure.

6. The structure of claim 5 wherein said covering is a flexible membrane.

7. The structure of claim 6 including tensioning means extending radially between said outer compression ring and said inner tension ring and between said support members for tensioning said flexible membrane.

8. The structure of claim 6 wherein said flexible membrane is a membrane selected from the class consisting of woven synthetic fabric, thin metallic, a fiberglass coated with polytetrafluoroethylene and a silicone-coated polyester.

9. A cable truss comprising continuous tension members and discontinuous compression struts, said tension members forming top and bottom chords extending between anchor means at each end of said truss, and diagonal chords extending between said top chords and said bottom chords, said compression struts attached between said top chords and said bottom chords, said top chords and said bottom chords each comprising a plurality of cables, the number of said cables within the top chord decreasing over the length of said cable truss while the number of said cables within said bottom chord inreasing over the length of said cable truss.

10. The truss of claim 9 wherein said top chords, bottom chords and diagonal chords are formed from said continuous tension members as a unitary member.

11. The truss of claim 9 wherein said tension members and compression members lie in a common plane.

12. A plurality of the cable trusses of claim 9 spanning a delineated area and having a membrane overlying said trusses to provide a roof over said delineated area.

13. The cable truss of claim 9 wherein said tension members comprise a bundle of cables extending over the length of said truss, certain ones of said cables continuously forming said top chords, said diagonal chords and said bottom chords.

14. The structure of claim 12 wherein said membrane is a membrane selected from the class consisting of woven synthetic fabric, thin metallic, a fiberglass coated with polytetrafluoroethylene and a silicone-coated polyester.

15. A structure for supporting a roof thereon comprising:

a generally horizontal outer compresion ring, a generally horizontal inner tension ring, a plurality of radially oriented support members affixed to said outer compression ring and extending radially inwardly therefrom and being affixed to said inner tension ring, each support member comprising, in a generally vertical plane, at least one upper, arched tensioned member forming a top chord, at least one diagonal tensioned member extending inwardly, downwardly and diagonally fromsaid upper tensioned member, and at least one substantially vertical, rigid strut in compression attached at its upper end to said upper tensioned member and attached at its lower end to said diagonal tensioned member, each such set of upper tensioned member, diagonal tensioned member and strut in compression forming a triangle in a generally vertical plane, these triangles forming discrete groups of triangular supports located at common radial positions between outer compression ring and inner tension ring, every said triangle in each said radially oriented support member having noncommon sides with every other triangle in said support member, and at least one generally horizontal tensioned hoop concentric with said outer compression ring and said inner tension ring and being affixed to the lower ends of each said strut in compression in each said group of triangular supports, and including a covering overlying said structure, wherein said covering is a flexible membrane, and including tensioning means extending radially between said outer compression ring and said inner tension ring and between said support members for tensioning said flexible membrane.

* * * * *

UNITED STATES PATENT AND TRADEMARK OFFICE

CERTIFICATE OF CORRECTION

PATENT NO. : 4,736,553

DATED : April 12, 1988

INVENTOR(S) : David H. Geiger

It is certified that error appears in the above-identified patent and that said Letters Patent is hereby corrected as shown below:

In the Specification:

In col. 5, line 54, please change "cross" to --crossing--.

In col. 8, line 67, please change "The" to --In--.

In col. 10, line 9, please change "was" to --has--.

In col. 10, line 13, please change "teh" to --the--.

In the Claims:

In col. 10, line 54, please change "horziontal" to --horizontal--.

In col. 10, line 54, please change "compressiong" to --compression--.

In col. 12, line 18, please change "compresion" to --compression--.

In col. 12, line 29, please change "fromsaid" to --from said--.

Signed and Sealed this

Ninth Day of August, 1988

*Attest:*

*Attesting Officer*

DONALD J. QUIGG

*Commissioner of Patents and Trademarks*